United States Patent [19]

Broide et al.

[11] 3,943,664

[45] Mar. 16, 1976

[54] PROFILE-GRINDING MACHINE

[76] Inventors: Pinkhus Ruvimovich Broide, prospekt Metallistov, 82, kv. 274; Igor Konstantinovich Surkov, ulitsa Zamshina, 25, korpus 2, kv. 156; Andrei Nikolaevich Grachev, ulitsa Ryleeva, 39, kv. 1, all of Leningrad, U.S.S.R.

[22] Filed: Feb. 20, 1973

[21] Appl. No.: 333,467

Related U.S. Application Data

[63] Continuation of Ser. No. 163,701, July 19, 1971, abandoned.

[52] U.S. Cl. ..... 51/5 D; 51/101 R

[51] Int. Cl.[2] ..... B24B 17/02

[58] Field of Search ..... 51/101 R, 5

[56] References Cited

UNITED STATES PATENTS

| | | | |
|---|---|---|---|
| 286,663 | 10/1883 | Wheeler | 51/101 R |
| 336,066 | 2/1886 | Richards | 51/101 R |
| 2,191,898 | 2/1940 | Nelson | 51/101 R |
| 2,334,938 | 11/1943 | Lang | 51/101 R |
| 2,600,548 | 6/1952 | Lalime | 51/5 |
| 2,723,500 | 11/1955 | Narel | 51/101 R |
| 2,815,611 | 12/1957 | Balsinger | 51/101 R |
| 2,944,373 | 7/1960 | Mentley | 51/5 |
| 3,668,812 | 6/1972 | Idel | 51/5 X |

*Primary Examiner*—Roy Lake
*Assistant Examiner*—Howard N. Goldberg
*Attorney, Agent, or Firm*—Holman & Stern

[57] ABSTRACT

A profile-grinding machine wherein the work stocks carry a turnable axle with rigidly secured jaw plates located between which, parallel to each other and to the axle, are an arbor for the work and a master form, interconnected kinematically for synchronous rotation. The master form interacts with a contact member installed on the bed. The working surface of the grindstone and the surface of the contact member interacting with the master form have approximately the same spherical surface.

2 Claims, 2 Drawing Figures

PROFILE-GRINDING MACHINE

This is a continuation of application Ser. No. 163,701 filed July 19, 1971, now abandoned.

BACKGROUND OF THE INVENTION

The present invention relates to metal-working machines and more specifically it relates to the profile-grinding machines used for machining convex-shaped articles.

The machine realized in accordance with the present invention will be used most successfully for grinding the backs of curved turbine blades.

Widely known in the art are profile-grinding machines for machining convex-shaped articles, mainly turbine blades, which comprise a bed mounting a grinding stock carrying the grindstone, and a mechanism for dressing said grindstone. The same bed mounts a movably installed bed plate which carries freemoving headstock and tailstock of the work.

The axle located between the headstock and tailstock carries an arbor for the work, and a master form. The master form interacts with a contact member in the form of a follow-up roller whose shape and dimensions correspond to those of the grindstone. As the master form starts rotating, the follow-up roller profiles the work via a mechanical (hydraulic or electrical, etc.) profiling system which actuates the grinding stock with the grindstone, or the bed plate with the work stocks.

The working surface of the grindstone follows a radius or a complex curve, the curvature in the longitudinal and transverse sections of the grindstone being different.

As the grindstone becomes gradually worn in operation and its cutting properties, shape and dimensions are restored by the dressing mechanism this leads to mismatching of the dimensions of the grindstone and follow-up roller which necessitates frequent replacement of the latter. Frequent changes of the follow-up rollers involving highly accurate installation and adjustments cut down the efficiency of the machines and hinder the rational utilization of the abrasive tools. In addition, the use of the follow-up roller in the capacity of the contact member limits the maximum possible diameter of the grindstone since the follow-up roller should have the same dimensions as the grindstone; this, in turn, makes the machine more bulky and complicates the replacement of the follow-up rollers which is called for by the wear of the grindstone.

Another disadvantage of the known machines lies in the difficulty with which the master form and arbor are reset relative to each other and to the follow-up roller and grindstone when the machine has to be switched over to grinding the articles of different dimensions.

SUMMARY OF THE INVENTION

An object of the present invention is to provide such a profile-grinding machine which will easily reset for handling the articles of different dimensions.

Another object of the present invention is to provide a machine with high machining accuracy and efficiency.

In accordance with these and other objects there is hereby disclosed a profile-grinding machine whose bed mounts a grinding head carrying a grindstone and its dressing mechanism, and a movable bed plate with work stocks which carry an arbor for said work, linked kinematically with a master form which interacts with a contact member and in which, according to the invention, the master form and the arbor are arranged parallel to each other between two jaw plates which are secured rigidly on an axle positioned in cross section at a right angle to the master form and arbour and set with a provision for moving in the work stocks. The working surface of the grindstone is of a spherical shape whose radius of curvature is equal to the grindstone radius while the contact member is installed on the bed and its surface interacting with the master form also has a spherical shape whose radius of curvature is approximately equal to the grindstone radius.

For dressing the spherical surface of the grindstone as it becomes gradually worn, advantageously the dressing mechanism is made in the form of a rocker whose fulcrum is located on an imaginary straight line passing through the grindstone axle and one of the rocker arms is connected to a drive while the other arm carries a stick mounted with a provision for progressive motion towards the center of the grindstone.

Such a design of the dressing mechanism is the simplest one for producing correct spherical shape of the working surface of the grindstone as said surface becomes gradually worn.

The profile-grinding machine of the present invention is simple to manufacture and is capable of machining convex-shaped surfaces, for example the backs of curved turbine blades, at the same time featuring high accuracy and efficiency. Also it is simple and reliable in operation since it requires no complex reseting while switching over to machining the articles with different dimensions, and permits easy and rapid replacement of the contact member in the course of grindstone wear.

The invention will now be described in detail by way of example with reference to the accompanying drawings in which:

DETAILED DESCRIPTION OF A PREFERRED EMBODIMENT

Figure 1:
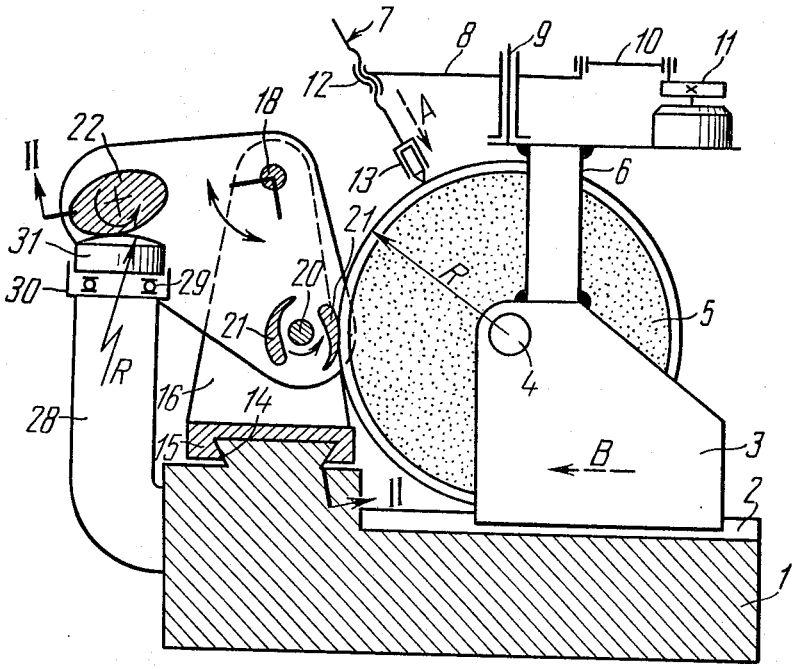
FIG. 1 is a schematic cross section of the profile-grinding machine according to the invention.

The profile grinding machine comprises a bed 1 (FIG. 1) with guides 2 which support a grinding stock 3. Mounted in this stock on an axle 4 is a grindstone 5 whose working surface represents part of a sphere with a radius R equal to the radius R of the grindstone 5.

Secured on the grinding stock 3 is a bracket 6 which mounts a grindstone dressing mechanism 7 whose kinematic arrangement ensures dressing of the working surface of the grindstone 5 over the sphere of radius R which is equal to the radius of the grindstone 5.

This mechanism comprises a rocker 8 installed to pivot about a fulcrum or axis 9 which is secured on a bracket 6. One arm of the rocker 8 is connected via a crank 10 to a drive 11 which upon rotation, serves to turn or swing the rocker 8 about the fulcrum or pivot axis 9. The other arm of rocker 8 carries a diamond stick 13 which is installed in helical guides 12 which serve to alter the angle of stick 13 with arm 8. When arm 8 swings about the fulcrum or axis 9, the point of the stick 13 consequently moves along an arcuate or circumferential path, which path will be seen to lie in a horizontal plane disposed normal to the plane of the drawing. This swinging of the stick 13 along the arcuate path serves to dress the spherical surface of the grindstone 5 when it becomes gradually worn in that the arcuate or circumferential path necessarily follows the outer perimeter or circumference of the spherical surface of grindstone 5. As should further be appreciated, the length of the arcuate or circumferential path followed by the stick 13, i.e., the stroke of stick 13, is selected through adjustment of the angle of swing and the length of rocker 18, this stroke advantageously exceeding the width of grindstone 5.

In the course of wear of the grindstone 5, the diamond stick 13 is moved progressively in guides 12 towards the center 4 of the grindstone 5 in the direction of arrow A by an individual drive (not shown in the drawings). In this fashion, the radius of the working surface of the grindstone 5 is accordingly reduced. Simultaneously, the grinding stock 3 is moved by an individual drive (not illustrated) through the same distance in the direction of arrow B.

Figure 2:
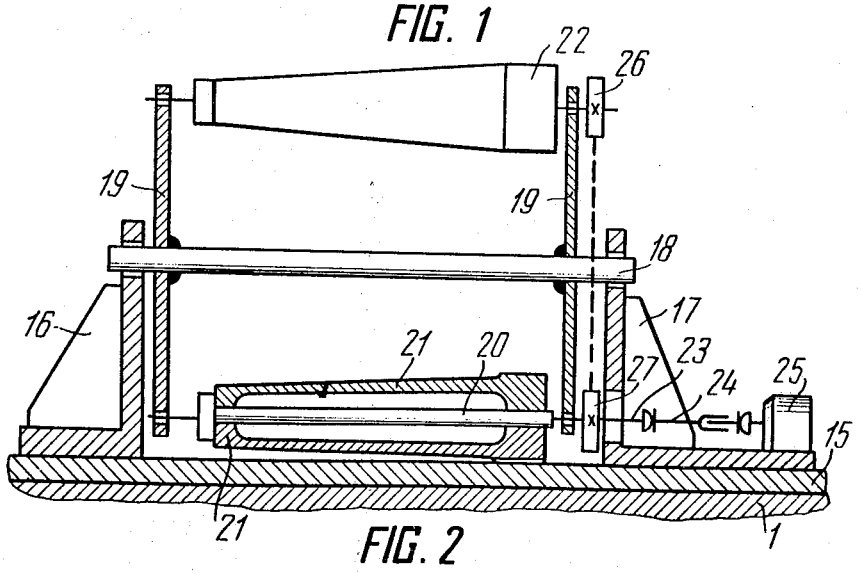
FIG. 2 is a section taken along line II—II in FIG. 1.

The bed plate 15 is installed in the guides 14 on the bed 1 and carries the headstock 16 and tailstock 17 (FIG. 2) of the work. The bed plate 15 is linked kinematically with the working feed drive (the drive and its kinematic linkage with the bed plate 15 is not shown for the sake of clarity of the drawings because this linkage can be constituted by any known means).

Installed with a provision for turning in the headstock 16 and tailstock 17 is the axle 18 carrying rigidly secured jaw plates 19. Located between these jaw plates, parallel to each other, are the arbor 20 for the work 21, and the master form 22. Each jaw plate 19 has the form of an isosceles right-angle triangle in which the axle 18 is located at the apex of the right angle while the arbor 20 and master form 22 are located at the apices of the acute angles.

Arrangement of the arbor 20 and master form 22 in a single unit which can turn around the axle 18 ensures easy and rapid resetting of the machine for handling work of a different size.

The arbor 20 is linked kinematically, via intermediate shafts 23 and 24, with the drive 25. The master form 22 is connected by gears 26, 27 and intermediate elements (not shown) with the drive 25 for synchronous rotation together with the arbor 20.

The bed 1 has a bracket 28 carrying a contact member 31 which is installed in the guides 20 on rolling-contact bearing 29.

The surface of the contact member 31 interacting with the master form 22 has a spherical shape. The radius of curvature R of this sphere is equal to the radius R of the curvature of the spherical surface of the grindstone 5.

The spherical shape of the working surface of the grindstone 5 allows a small-size contact member 31, to be made in which only the surface directly interacting with the master form follows the spherical shape of the grindstone working surface.

The profile-grinding machine functions as follows:

The work 21 (turbine blades) is secured on the arbor 20. Then the drive (not shown) of the grindstone 5 and the drive 25 are turned on. The drive 25 imparts synchronous rotation to the master form 22 and arbor 20 via the intermediate shafts 23, 24, gears 26, 27 and intermediate elements (not shown); the longitudinal feed drive (not shown) of bedplate 15 is also turned on. The rotating master form 22 rolls over the spherical shape of the contact member which can be rotated in the guide 30 on the rolling contact bearing 29 by friction forces.

Rolling over the spherical surface of the contact member 31, the master form 22 turns the axle 18 with the rigidly secured jaw plates 19 and, together with the axle, turns arbor 20 with relation to the headstock 16 and tailstock 17 of the work and with relation to the grindstone 5 which has a rotary motion only. In this manner the contour of the work 21 is profiled.

As the grindstone 5 gradually loses its shape and becomes worn, it is dressed by the diamond stick 13. For this purpose the diamond stick 13 is fed towards the center of the grindstone 5 along arrow A to the required value of dressing. Then the drive 11 is turned on and the rocker 8 is rotated, via the crank 10, around the fulcrum 9. In view of the fact that the fulcrum 9 of the dressing mechanism 7 intersects the axle 4 of the grindstone 5, the diamond stick 13 moving along the arc of the circumference will dress the grindstone 5 on its sphere, the radius of said sphere diminishing with the progressive feed of the diamond stick 13. After the radius of the grindstone 5 has changed, the grinding head 3 should be moved along arrow B to a distance equal to the dressing feed.

After the radius R of the grindstone 5 and, consequently, the radius R of the sphere of the working surface, have changed to a value limited by the selected mismatching of the radius of the working surface of the grindstone 5 with the radius of the sphere of the contact member 31, the latter has to be changed. The radius of the spherical surface of the new contact member 31 must be close to the new radius of the grindstone sphere.

An experimental specimen of the profile-grinding machine realized in accordance with the present invention has been tested within a year by machining the backs of curved turbine blades with a length of over 300 mm. The matching accuracy of the blades has met the required specifications.

We claim:

1. A profile-grinding machine comprising a bed; a grinding stock movably installed on said bed; a grindstone with a spherical working surface mounted on said grinding stock; a dressing mechanism installed on said grinding stock and interacting with the working surface of the grindstone for dressing its sphere as it gradually becomes worn; a bed plate installed on said bed with a provision for reciprocating motions; work stocks located on said bed plate; an axle installed with a provision for turning in said work stocks; jaw plates rigidly secured on said axle; an arbor for the work, installed between said jaw plates; a master form installed between said jaw plates, parallel to said arbor; said axle, master form and arbor being arranged so that they form an imaginary right-angle triangle with the axle located at the apex of its right angle while the master form and the arbor are located, respectively, at the apices of the acute angles; a contact member installed on said bed and interacting with said master form; the surface of the contact member interacting with the master form being of spherical shape whose radius of curvature is approximately equal to the radius of the grindstone.

2. A machine according to claim 1 wherein the mechanism used for dressing the spherical surface of the grindstone to make up for its gradual wear is made in the form of a rocker having two rocker arms and whose fulcrum is located on an imaginary straight line passing through the grindstone axle, one of the rocker arms being connected to the drive while the other one carries a diamond stick mounted with a provision for progressive motion towards the centre of the grindstone.

* * * * *